US005669032A

United States Patent [19]

Islam et al.

[11] Patent Number: 5,669,032

[45] Date of Patent: *Sep. 16, 1997

[54] CONSTRAINED FILM HEAT PROCESSOR AND METHOD OF DEVELOPING DIGITAL FILM USING CONDUCTION HEAT TRANSFER

[75] Inventors: Abu S. Islam, Mt. Vernon; Robert J. Kleckner, Yorktown Heights; Leo Chin, Bronx, all of N.Y.; Sandra Graveson, Waterbury, Conn.

[73] Assignee: Xerox Corporation, Stamford, Conn.

[ * ] Notice: The term of this patent shall not extend beyond the expiration date of Pat. No. 5,034,167.

[21] Appl. No.: 549,293

[22] Filed: Oct. 27, 1995

[51] Int. Cl.[6] ..... G03D 7/00

[52] U.S. Cl. ..... 396/579; 219/216

[58] Field of Search ..... 354/300; 34/640; 219/216, 400; 396/579

[56] References Cited

U.S. PATENT DOCUMENTS

| | | | |
|---|---|---|---|
| 3,570,383 | 3/1971 | Berg | 354/300 |
| 4,293,212 | 10/1981 | Siryj et al. | 354/300 |
| 4,358,192 | 11/1982 | Goldberg et al. | 354/300 |
| 5,086,209 | 2/1992 | Kintz et al. | 219/216 |

*Primary Examiner*—D. Rutledge

*Attorney, Agent, or Firm*—Kevin R. Kepner

[57] ABSTRACT

An apparatus and method of developing a heat developing film includes a film support surface for supporting and constraining a film and heaters for developing the film supported on the film constraining surface. The film constraining surface may either be stationary or form part of a film transport. The film transport may either be a continuous film transport or a reciprocating film transport. The continuous film transport may be inclined or include an input pinch roller. In addition, the heaters may either be stationary, reciprocatable, or pivotable. The heat is applied by conduction and may include a profiled heater output to control uniformity of the temperature. The apparatus may be provided as a stand-alone unit or may be coupled, either externally to or within, a film exposure device.

15 Claims, 5 Drawing Sheets

CONSTRAINED FILM HEAT PROCESSOR AND METHOD OF DEVELOPING DIGITAL FILM USING CONDUCTION HEAT TRANSFER

The present invention relates to a method and apparatus for developing digital film, and specifically, to a method and apparatus for developing film by applying heat to the film while the film is constrained.

In conventional digital film processing apparatuses, the film is first made sensitive to light by electrostatically charging the film. A latent image is then formed on the film by exposing the film to light from a modulated laser or similar device. The exposed film is developed by applying heat to the film.

In a first conventional film processing apparatus, a heated metal plate is provided for heating the film. The film is manually applied directly to the surface of the heated plate. The operator then manually counts a period of time, after which the film is removed from the surface of the plate. Since this arrangement requires extensive manual activity, productivity is low and film developing costs are high.

In a second conventional film processing apparatus, heating is accomplished by providing at least one heated roller between input and exit pinch rollers. The pinch rollers serve to feed the film past the heated roller while maintaining tension on the film to assure good contact with the heated roller. The film is heated by conduction through contact with the heated roller.

However, with the second arrangement, several problems arise. First, the leading and trailing edges of the film may be incompletely or poorly developed. This occurs because the leading and trailing edges are not under tension when they pass over the heated roller. As a result, sufficient contact between these edges of the film and the heated roller is not achieved.

In addition, the side edges of the film may also be poorly or incompletely developed. This is because the ends of the heated roller, which are mechanically coupled to other portions of the processing apparatus (e.g. the bearings, frame, etc.), act as heat sinks. Consequently, the temperature at the ends of the heated roller may be insufficient to properly develop the latent image at the side edges of the film. While the heated roller may be lengthened in order to provide a more uniform temperature distribution along that portion of the heated roller in contact with the film, this has the undesirable consequences of increasing both manufacturing costs and the size of the footprint of the film processing apparatus.

Moreover, during the film heating process, emulsion of the film softens and must be cooled prior to being mechanically contacted. Unless an external cooling device is provided for cooling the film prior to contact with the exit pinch rollers, the exit pinch rollers must be positioned sufficiently-far down stream of the heated roller in order to permit the film to be cooled by natural convection. As a consequence, film is wasted on the leading and trailing edges.

Further, heat-developing film generally includes a polyester base which may permanently deform when heated under tension. In addition, if the film is not sufficiently cooled prior to entering the exit roller nip, further cooling occurring while the film is constrained in the nip can lead to the formation of ripples or other undesirable deformations of the film.

In a third conventional film heating apparatus, described in copending U.S. patent application Ser. No. 08/434,960, now U.S. Pat. No. 5,587,767, commonly assigned to the assignee herein, a means for supporting film and a heating device for developing the film without contacting the film is described. The device has the advantage of edge-to-edge film development, however the device may produce undesirable ripples in the film if the development temperature requirement is high.

A fourth film heating apparatus, described in a co-pending application U.S. patent application Ser. No. 08/548,628, filed on even date herewith, now U.S. Pat. No. 5,634,167, commonly assigned to the assignee herein, titled "Constrained Film Heat Processor and Method of Developing Digital Film by Radiant Heat Transfer", the film is constrained by a vacuum platen and heated by radiant heaters. The referenced device can produce high quality, developed film. However, the materials that are necessary for the vacuum platen are limited by to the high temperatures required for the radiant heaters.

For the foregoing reasons, there exists a need for a film processor which can develop heat-developing film with high productivity, quality and at lower cost. There also exists a need for a film processor which can develop the film without leading, trailing, or side edge deletion. In addition, there exists a need for a film processor that can develop heat-developing film while maintaining dimensional stability of the film at higher development temperatures.

The following disclosures may be relevant to various aspects of the present invention:

U.S. patent application Ser. No. 08/434,960, now U.S. Pat. No. 5,587,767

Inventor: Islam et al.

Filed: May 4, 1995

The relevant portions of the foregoing disclosures may be briefly summarized as follows:

U.S. patent application Ser. No. 08/434,960 describes an apparatus and method of developing a heat developing film includes a film support surface for supporting a film and heaters for developing the film supported on the film support surface. The film support surface may either be stationary or form part of a film transport. The film transport may either be a continuous film transport or a reciprocating film transport. The continuous film transport may be inclined or include an input pinch roller. In addition, the heaters may either be stationary, reciprocatable, or pivotable. The heaters are radiant heaters which may include a profiled heater output to control distortion of the film. The apparatus may be provided as a stand-alone unit or may be coupled, either externally to or within, a film exposure device.

In accordance with one aspect of the present invention, there is provided an apparatus for processing film. The apparatus comprises a film support and constraining device and a conduction heating device for developing the film on said film support and constraining device without contacting the film.

Pursuant to another aspect of the present invention, there is provided a method of developing film. The method includes the steps of providing a film support and constraining surface and developing a film supported on said film support and constraining surface by applying heat from a heating device to the film without contacting the film.

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
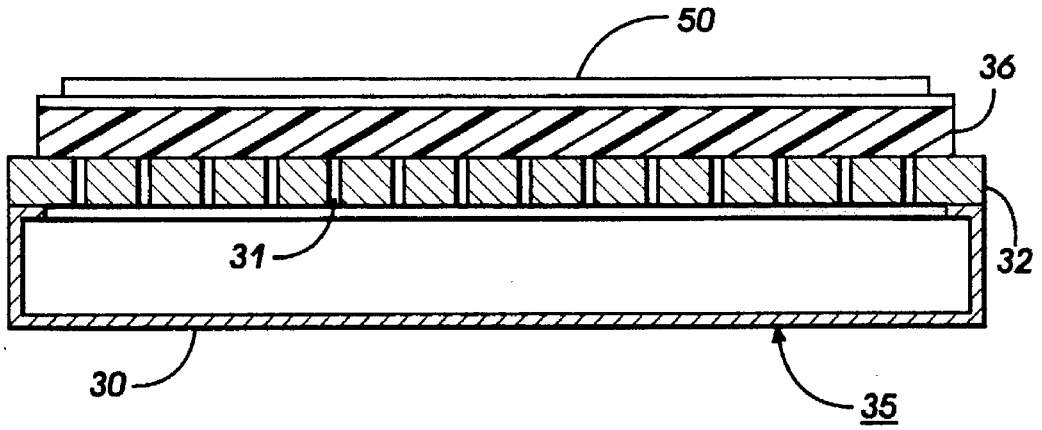
FIG. 1 is a cross sectional view of a first embodiment of a film support and constraining device.
Figure 2:
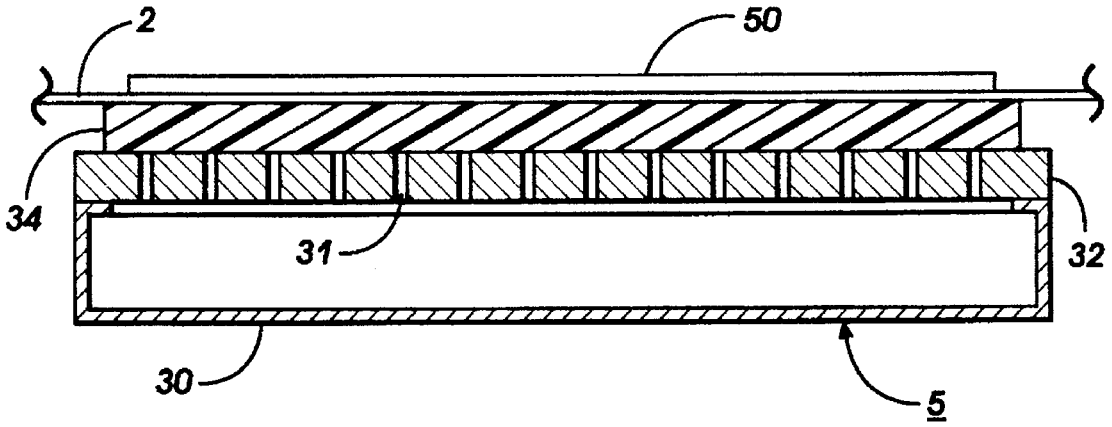
FIG. 2 is a cross sectional view of a second embodiment of a film support and constraining device.

FIGS. 1 and 2 illustrate two embodiments of film supporting and constraining devices for use in the film development heaters The hardware consists of a vacuum platen, a diffusion layer, and a surface material which may or may not be of the same material as the diffusion layer. The platen could be flat or curved, to suit the need. In practice, the film is placed, by hand or other means, on the surface of the vacuum platen. Vacuum is applied and the film is held in place by a force that is proportional to the vacuum pressure. The vacuum will tend to smooth the film, and when seated, the film will assume the shape of the vacuum platen surface. When the film is heated an cooled, while supported in this manner, flat (ripple free) film can be produced at a higher temperature than prior art heaters. Two examples of the vacuum platens for this application are described below.

FIG. 1 shows a vacuum platen, generally referred to as reference numeral 5, in which the film and the platen do not move relative to each other. The film is placed upon the platen surface with its emulsion side up. Beneath the film is a first layer of material 36. Material 36 should be porous, thermally insulating, smooth, thermally stable. An example of such material is a plastic foam with a porous skin coating such as Part No. PU8-45, manufactured by Porvair, Inc., of Norfolk, England. Beneath this layer is a structural substrate 32, that is structurally sound, thermally conductive, and contains a pattern of holes/grooves 31 for application of the vacuum. Most metallic type materials are suitable for such use. Further, structural substrate 32 may, depending upon the application, be heated. The heat would reduce the time required for the heat processor to warmup. Beneath this layer is the vacuum plenum 30, for the distribution of vacuum to the vacuum holes 31 in the layer 36 above it. The vacuum plenum is connected to the vacuum pump (not shown) via suitable conduit.

FIG. 2 illustrates a vacuum platen 5 in which the film and the platen move relative to each other. The film is placed on the surface of a conveyor belt 2 with its emulsion side up. The conveyor belt 2 must be porous, thermally insulating and smooth, so as to prevent embossing of the film when heated under vacuum. Suitable materials for construction of such a belt are Teflon coated fiberglass weave materials. Beneath the conveyor belt 2 is a layer of vacuum diffusion material 34 that is porous, thermally stable, wear resistant, slippery and thermally insulating. Teflon coated fiberglass weave materials are suitable example materials for such use. Beneath this layer is a structural substrate 32, that is structurally sound, thermally insulating and contains a pattern of holes/grooves 31 for application of the vacuum. Further, structural substrate 32 may, depending upon the application, be heated. The heat would reduce the time required for the heat processor to warm-up. Beneath this layer is the vacuum plenum 30, for the distribution of vacuum to the vacuum holes 31 in the layer 32 above it. The vacuum plenum 30 is connected to the vacuum pump (not shown) via suitable conduit.

A critical parameter for the successful operation of the heat processor is the height of the air gap between the conduction element and the surface of the film. This air gap offers a resistance to conductive heat transfer between the conduction element and the film. If the gap varies, the temperature of the film will also vary. Therefore, precise but achievable control of the air gap thickness is necessary. A differentiating feature between this invention and the invention described in "Constrained Film Heat Processor and Method of Developing Digital Film by Radiant Heat Transfer" is the gap tolerance. When using radiant heaters, a large gap with a wide tolerance is permissible. Here, the gap is small and must be tightly controlled. The fact that the film is constrained to the surface of the platen while heated makes the small gap viable.

Those skilled in the art could design systems that employ electrostatic force to hold the film in place, although this technique was not attempted by the inventors at this time. Other methods to constrain the film might also be envisioned. This invention therefore describes, but is not limited to, a reduction to practice where vacuum is used to constrain the film during heat development.

Figure 3:
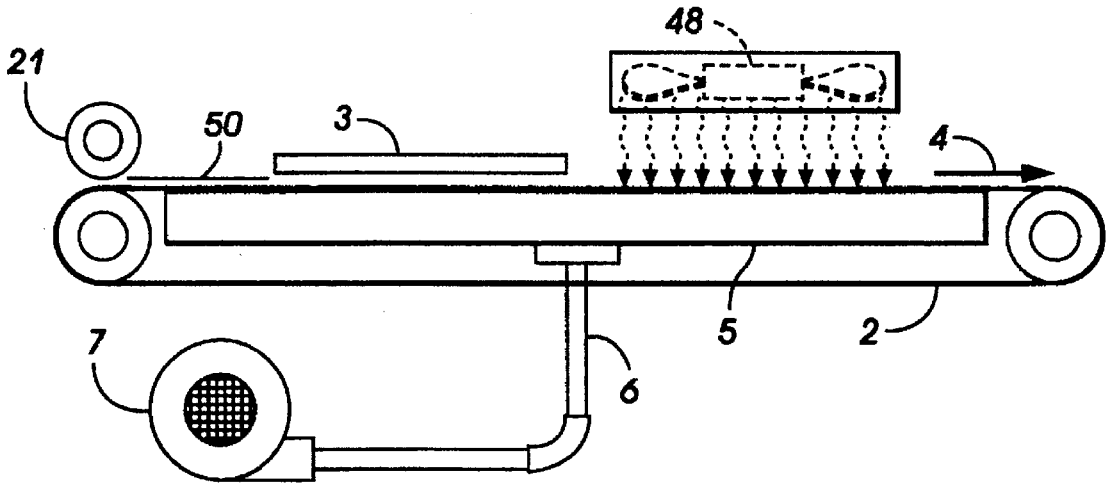
FIG. 3 is a schematic view of a film heat processor using the FIG. 2 constraining device.

FIG. 3 is a schematic view of film heat processor according to the first embodiment of the invention. The film heat processor 1 includes a continuous transport 2, such as an endless belt conveyor, for receiving a heat-developing film 50 at input 1, a vacuum platen 5, the pump or blower 7 for creating a vacuum and the means for applying the vacuum to the vacuum platen 6. The film 50 may either be manually loaded onto the continuous transport 2 or directly supplied thereto from a well known film exposure device, such as an imagesetter. The film may be, by way of example, a migration imaging film that can be developed using radiant energy.

The continuous transport 2 conveys the film in the direction shown by arrow 4 past heaters 3 for developing. The heaters 3 are configured so that the film temperature is spatially constant along a direction perpendicular to the direction of movement of the film 50.

The desired heater output can be achieved in a number of ways by one familiar with the conventional art. Specific examples of heating arrangements for achieving the desired results are discussed next.

Figure 4:
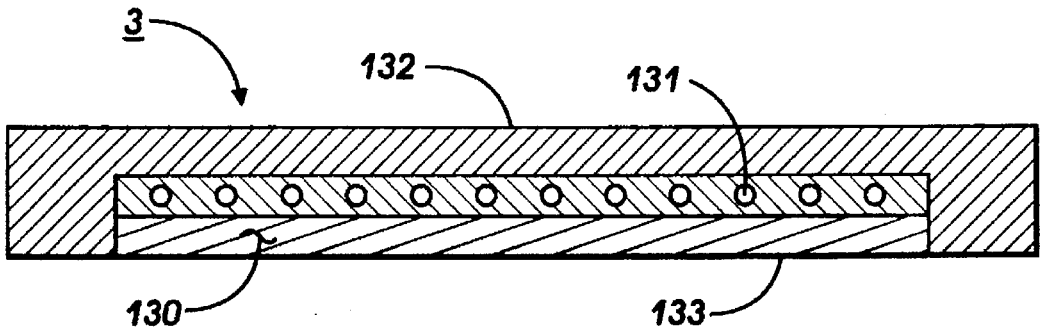
FIG. 4 is a cross sectional view of a conductive heating element used in the present invention.

FIG. 4 shows a cross section through heater 3. A single heating element, or preferably a plurality of heating elements 131, are used to raise the temperature of the conduction element 130. A plurality of heaters is preferred because it will shorten the warm-up time and provide a more spatially uniform output of heat. The conduction element 130 serves to average the heat output of the heating elements 131 and maintain a uniform temperature over its entire surface 133. The conduction element and the heating elements are contained within a thermally insulating housing 132.

The conduction element 130 can be manufactured from a high thermal conductivity material, such as copper. A heat pipe could also be used for this application. The design objective is to maintain uniform temperature over the output face of the conduction element 133. The output face of the conduction element must be geometrically flat, so that the resulting gap between the output face and the film is substantially constant.

The heating elements 131 could be made from resistance heaters. Resistance heaters can be purchased in rod, wire and sheet form.

A vacuum platen 5, as illustrated in FIG. 2, is located beneath the endless conveyor 2. Vacuum is applied through pipes or tubing 6. Pump or blower 7 is used for vacuum.

A technique and device to guide the conveyor belt is described in a co-pending application U.S. patent application Ser. No. 08/548,566, now U.S. Pat. No. 5,644,379, filed on even date herewith and commonly assigned, titled "Passive Belt Guidance by Fabric Weave Orientation" the disclosure of which is hereby incorporated by reference.

The operation of the first preferred embodiment will now be described.

Film 50 is placed upon the conveyor belt 2 at the input section of the device 1. The movement of the conveyor brings the film over the vacuum platen, where both the belt and the film become flattened against the platen surface. While in this flat shape, the film is further transported to and through the conductive heater section. Here, the film is heated while it is constrained due to the action of the vacuum platen. The heated film 50 then exits the heater section. Upon its exit from the heater, the film enters a cooling zone C. The film 50 is cooled, by natural or forced convection and the conduction of heat through the surface of the vacuum platen. A cooling fan 48 is shown for illustration. Once cooled, the film 50 moves to the output section O. The film 50 may then be manually retrieved or delivered to an output tray (not shown).

Although the film processor 1 is shown as having a conveying surface appropriately sized to the width of a single sheet of film, it is understood that the width of the conveying surface may be increased in order to permit a plurality of films to be simultaneously developed.

Film processor 1 may include a soft, or resiliently compliant, pinch roller 21 for forming a nip with the continuous transport 2 and thus aiding in the loading of film 50.

When the film heat processor 1 is combined with an exposure device, it may either be connected externally to the exposure device or be formed as an integral part of the exposure device as a single unit construction. A film buffer may be provided between the exposure device and the film processor in order to permit temporary accumulation of the film prior to developing. In addition, the continuous transport 2 is preferably driven with a speed at least as great as the speed at which the film travels through the exposure device in order to enhance productivity.

The film heat processor shown in FIG. 3 can be made to operate in several modes. The first mode involves continuous motion of the conveyor belt.

In a second mode, the belt moves incrementally. This mode of operation will now be described. Film 50 is applied to the belt surface while the belt 2 is stationary and the vacuum pump 7 is off. The film 50 is then moved, by the conveyor motion, under the plurality of heaters 3 and the vacuum is applied. The film 50 is stationary while heated. Once sufficiently heated the belt 2 and film 50 is moved to the cooling station C. Once cooled, the film 50 is then output from the machine at the output station O. This incremental mode of operation has the advantage that it reduces power consumption and it reduces belt 2 and platen 5 wear. Wear is reduced because the vacuum is off during the part of the operational cycle when the belt 2 is moved relative to the platen 5.

One skilled in the art might envision several other modes of operation for the film processor of FIG. 3. This invention proposal therefore describes, but is limited to, the two modes of operation described above.

Figure 5:
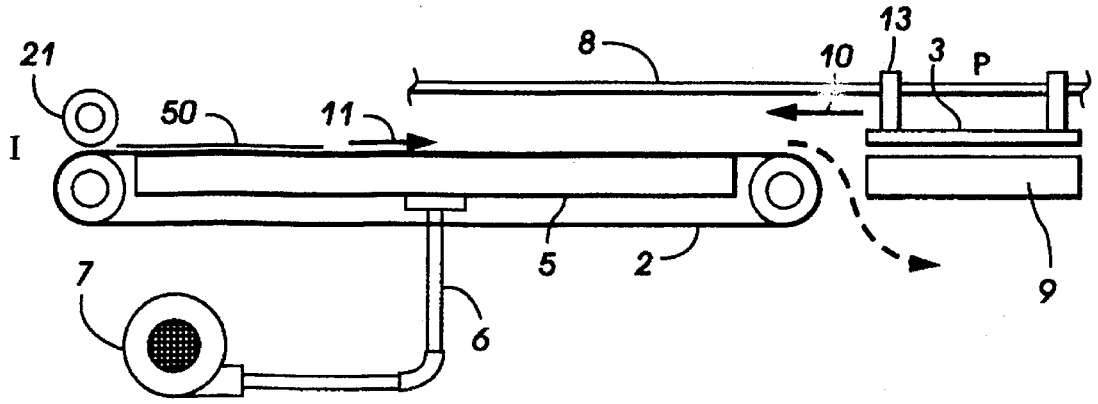
FIG. 5 is a schematic view of a second embodiment of a film heat processor using the FIG. 2 constraining device.

FIG. 5 is a schematic view of film heat processor according to a second embodiment of the invention. The film heat processor includes a reciprocating heater transport 13 and heat insulation 9. The operation of the film heat processor FIG. 5 will now be described.

The film 50 is placed on the input section of the device 1. The vacuum is off and the heater 3 is located at its parked position P. The conveyor 2 is incrementally moved in the direction of the arrow 11 so as to position the film over the vacuum platen 5. The vacuum is then applied by pump or blower 7 through plumbing 6, thereby holding the film in a flat position. The plurality of heaters 3 is then moved in the direction of arrow 10 thereby heating the film. The rails 8, or other equivalent mechanical means, guide the heaters 3 along the reciprocating path. After heating, the heaters 3 are returned to their parked position P. The film is allowed to cool while constrained by the vacuum. Once cooled, the vacuum is removed. The belt 2 then moves in an incremental motion in the direction of arrow 11. The film is thereby delivered to the output section O.

As in the first embodiment, the film transport 2 may receive film either manually or directly from an exposure device to which it is either externally connected or contained within. The second embodiment provides substantial power reduction because the belt is not moved when the vacuum is on. It also provides for significantly reduced belt 2 and platen 5 wear. The benefits are derived at the added expense of the heater transport 8.

Figure 6:
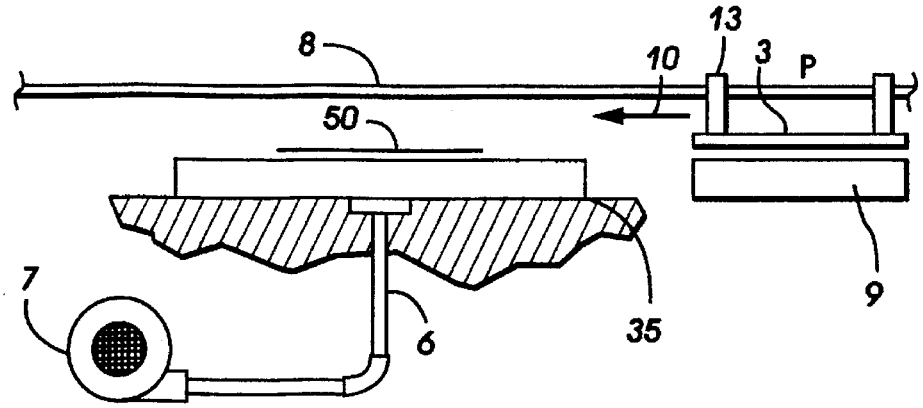
FIG. 6 is a schematic view of a third embodiment of a film heat processor using the FIG. 1 constraining device.

FIG. 6 is a schematic view of a film heat processor according to a third embodiment of the invention. The film heat processor FIG. 3 includes a vacuum platen 35 as illustrated in FIG. 1, and a reciprocating heater transport 13. The film 50 is loaded on the surface 36 of the vacuum platen 35. The vacuum is applied by pump or blower 7 through conduit 6, thereby holding the film 50 in a flat position. The heaters 3 are moved from their parked position P in a reciprocating motion. Once the film 50 is heated, it is permitted to cool while the vacuum is applied. At the end of the cooling cycle the vacuum is stopped and the film 50 is removed from the device.

Figure 7:
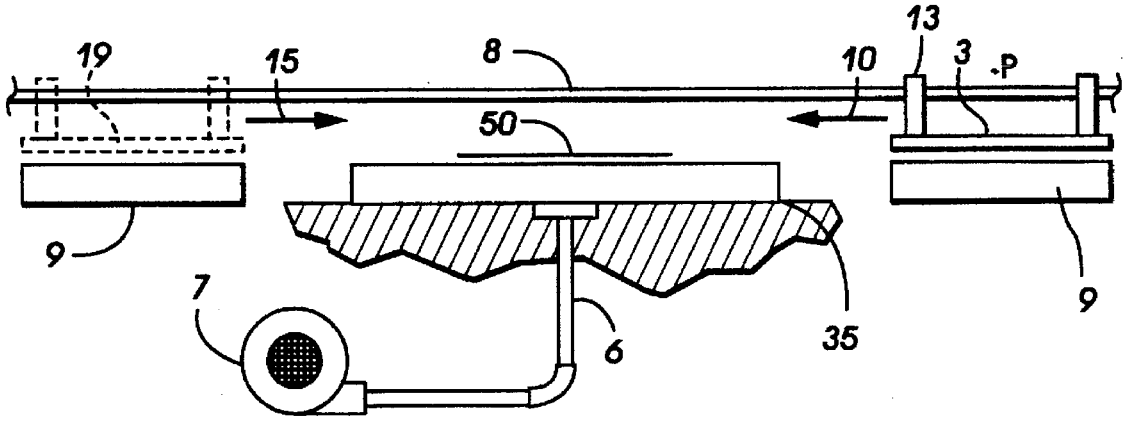
FIG. 7 is a schematic view of a fourth embodiment of a film heat processor using the FIG. 1 constraining device.

FIG. 7 is a schematic view of film heat processor according to a fourth embodiment of the invention. The film heat processor FIG. 4 includes a vacuum platen 35 as illustrated in FIG. 1, and a heater transport 13. The film 50 is loaded on the surface 36 of the vacuum platen 35. The vacuum is applied by pump or blower 7 through plumbing 6, thereby holding the film 50 in a flat position. The heaters 3 are moved from their parked position P to the opposite side along the direction of arrow 10. Their final position is indicated by the dashed lines 19, above thermal insulation 9. Once the film 50 is so heated, it is permitted to cool while the vacuum is applied. At the end of the cooling cycle the vacuum is stopped and the film 50 is removed from the device. The final position 19 of this heating cycle then becomes the initial position for the heaters 3, which then move in the direction of arrow 15 for the next heating cycle, and so on. This embodiment has the advantage of reduced cost when compared to FIG. 3 and FIG. 4.

Figure 8:
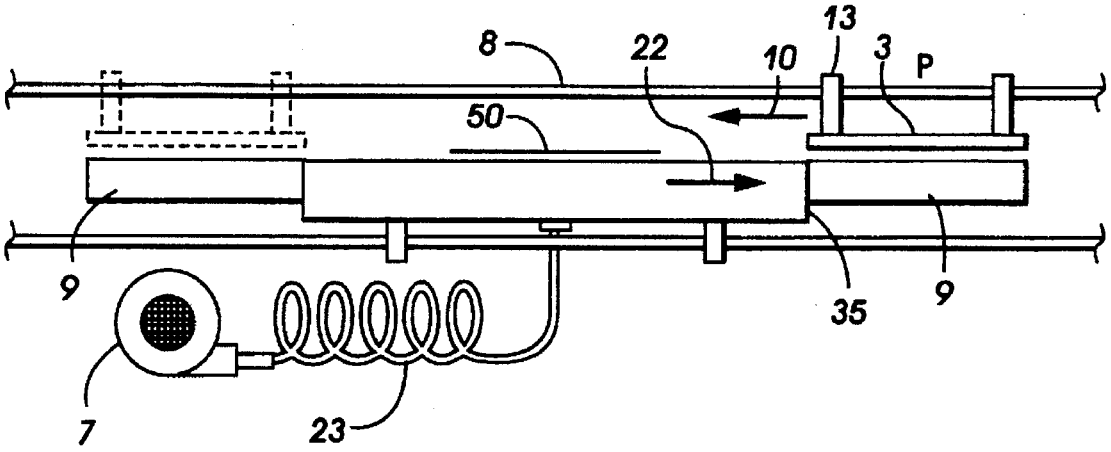
FIG. 8 is a schematic view of a fifth embodiment of a film heat processor using the FIG. 1 constraining device.

FIG. 8 is a schematic view of a film heat processor according to a fifth embodiment of the invention. The embodiment of FIG. 8 differs from the fourth embodiment in that a reciprocating drive 24 is provided for reciprocating the vacuum platen 35 parallel, but in a direction 22 opposite to, the heater conveying direction 10. Specifically, the heaters 3 are synchronized so as to directly oppose movement of the reciprocating film platen 35. Viewing FIG. 8, as the film 50 travels left to right in the direction of arrow 22, heaters 3 travel right to left in the direction of arrow 10. In that the vacuum platen 35 now moves, flexible tubing 23 is used to apply the vacuum to the platen 35. With this arrangement, the footprint of the film heat processor FIG. 7 is even further reduced over the prior embodiments.

Figure 9:
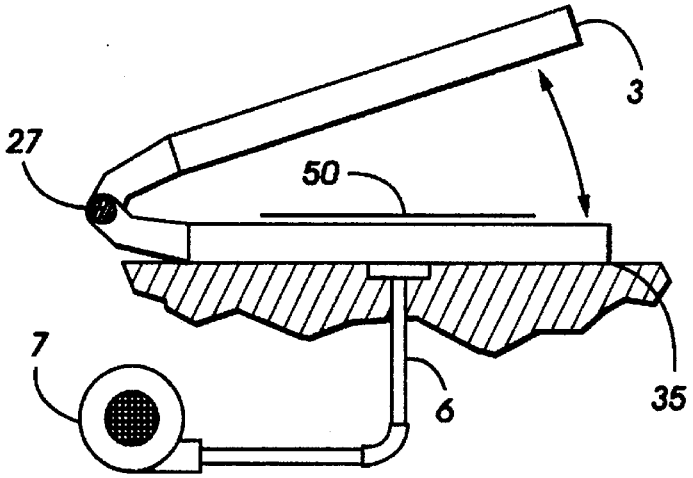
FIG. 9 is a schematic view of a sixth embodiment of a film heat processor using the FIG. 1 constraining device.

FIG. 9 is a schematic view of film heat processor according to a sixth embodiment of the invention. The film heat processor FIG. 9 includes a hinge 27 for pivotally supporting the heater 3. The hinge 27 controls the closed, ie. operating, position of the heater 3 so that contact between the film 50 and the surface of the heater 3 during developing is prevented. The size of the heater 3 is selected such that at least one, and preferably several sheets of film 50 may be developed simultaneously.

This embodiment has the advantage of requiring the lowest operating temperature for a given heating time, since the entire film(s) is heated at once. In addition, since several film sheets may be processed at once, production efficiency is increased. Due to the use of vacuum to hold the film during development, the film heat processors described above may be operated at an inclined position, thus further reducing the foot print of the device.

While this invention has been described in conjunction with specific embodiments thereof, it is evident that many alternatives, modification and variations will be apparent to those skilled in the art. Accordingly, the preferred embodiments of the invention as set forth herein are intended to be illustrative, not limiting.

In recapitulation, there is provided an apparatus and method of developing a heat developing film includes a film support surface for supporting and constraining a film and heaters for developing the film supported on the film constraining surface. The film constraining surface may either be stationary or form part of a film transport. The film transport may either be a continuous film transport or a reciprocating film transport. The continuous film transport may be inclined and/or include an input pinch roller. In addition, the heaters may either be stationary, reciprocatable, or pivotable. The heat is applied by conduction and may include a profiled heater output to control uniformity of the temperature. The apparatus may be provided as a standalone unit or may be coupled, either externally to or within, a film exposure device.

It is, therefore, apparent that there has been provided in accordance with the present invention, a method and device for constrained heat development of a film that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

What is claimed is:

1. An apparatus for processing film, comprising:

a film support and constraining device;

a heating device for developing the film on said film support and constraining device without contacting the film wherein said heating device is a conductive heating element and wherein said film support and constraining device comprises:

a vacuum source;

a plenum chamber adapted to be connected to said vacuum source;

a porous support surface connected to said plenum so that the film on said surface is held thereto by a vacuum wherein said porous support surface comprises a structural substrate and a smooth porous insulative layer between said structural substrate and the film.

2. An apparatus according to claim 1, wherein said heating device has a surface area at least as large as the film to be developed.

3. An apparatus for processing film, comprising:

a film support and constraining device;

a heating device for developing the film on said film support and constraining device without contacting the film wherein said heating device is a conductive heating element and wherein said film support and constraining device comprises:

a vacuum source;

a plenum chamber adapted to be connected to said vacuum source;

a porous support surface connected to said plenum so that the film on said surface is held thereto by a vacuum, wherein said porous support surface comprises a structural substrate, a vacuum diffusion layer attached to said structural substrate and a smooth porous conveying layer between said vacuum diffusion layer and the film.

4. An apparatus according to claim 3, wherein said heating device has a surface area at least as large as the film to be developed.

5. An apparatus for processing film, comprising:

a film support and constraining device; and a heating device for developing the film on said film support and constraining device without contacting the film wherein said heating device is a conductive heating element and wherein at least one of said film support surface and said conductive heating device is movable further comprising a film transport for conveying the film past the heating device, said film transport including said film support and constraining surface.

6. An apparatus according to claim 5, wherein said film transport is a continuous film transport.

7. An apparatus according to claim 6, wherein said continuous film transport comprises at least one endless belt.

8. An apparatus according to claim 5, wherein film transport is a reciprocating film transport.

9. An apparatus according to claim 5, wherein said conductive heating device is a reciprocating heating device.

10. An apparatus according to claim 9, wherein said conductive heating device and said film transport move synchronously in opposite directions.

11. A method of developing film including the steps of:

providing a film support and constraining surface;

developing a film supported on said film support and constraining surface by applying heat from a heating device to the film without contacting the film; and further comprising the step of moving the film support and constraint surface relative to the heating device.

12. The method of claim 11, further comprising the step of providing a continuous film transport.

13. The method of claim 11, further comprising the step of providing a reciprocating film transport.

14. The method of claim 11, wherein said moving step includes moving the heating device.

15. The method of claim 11, wherein said heat applying step includes applying conductive heat energy to the film.

* * * * *

UNITED STATES PATENT AND TRADEMARK OFFICE

CERTIFICATE OF CORRECTION

PATENT NO. : 5,669,032

DATED : September 16, 1997

INVENTOR(S) : Islam et al.

It is certified that error appears in the above-identified patent and that said Letters Patent is hereby corrected as shown below:

On the title page: [*] Notice

REPLACE 'The term of this patent shall not extend beyond the expiration date of Pat. No. 5,034,167." with "The term of this patent shall not extend beyond the expiration date of Pat. No. 5,634,167.".

Signed and Sealed this

Third Day of February, 1998

*Attest:*

*Attesting Officer*

BRUCE LEHMAN

*Commissioner of Patents and Trademarks*